US007669984B2

(12) United States Patent
Maeda

(10) Patent No.: US 7,669,984 B2
(45) Date of Patent: Mar. 2, 2010

(54) LIQUID EJECTION HEAD, IMAGE FORMING APPARATUS AND LIQUID SUPPLY METHOD FOR LIQUID EJECTION HEAD

(75) Inventor: Yasuhiko Maeda, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 304 days.

(21) Appl. No.: 11/717,114

(22) Filed: Mar. 13, 2007

(65) Prior Publication Data

US 2007/0216722 A1 Sep. 20, 2007

(30) Foreign Application Priority Data

Mar. 14, 2006 (JP) ..... 2006-069843

(51) Int. Cl.
*B41J 2/045* (2006.01)

(52) U.S. Cl. ..... 347/68

(58) Field of Classification Search ..... 347/40, 347/43, 65–72

See application file for complete search history.

(56) References Cited

U.S. PATENT DOCUMENTS

2002/0071009 A1 6/2002 Yamada et al.
2005/0062800 A1* 3/2005 Enomoto et al. ..... 347/42

FOREIGN PATENT DOCUMENTS

| | | | |
|---|---|---|---|
| JP | 7-323541 | A | 12/1995 |
| JP | 2002-19110 | A | 1/2002 |
| JP | 2002-178509 | A | 6/2002 |

* cited by examiner

*Primary Examiner*—Lamson D Nguyen
(74) *Attorney, Agent, or Firm*—Birch, Stewart, Kolasch & Birch, LLP

(57) ABSTRACT

The liquid ejection head includes: a head main body which is constructed from a plurality of head units layered together in a layering direction perpendicular to a liquid ejection direction of nozzles, each of the head units having the nozzles, pressure chambers connected with the nozzles and arranged in a one-dimensional configuration, and piezoelectric elements corresponding to the pressure chambers and arranged in a one-dimensional configuration, the head main body having through channels substantially parallel to the layering direction of the head units, the through channels being in connection with the pressure chambers; and first and second liquid accommodating chambers which are arranged on sides of the head main body opposing to each other in the layering direction of the head units, the first and second liquid accommodating chambers being in connection with the through channels.

4 Claims, 12 Drawing Sheets

110
112
114
116
118
120
122
200A
200B
200C
200D
200E
50
56A
56B
72
74

LIQUID EJECTION HEAD, IMAGE FORMING APPARATUS AND LIQUID SUPPLY METHOD FOR LIQUID EJECTION HEAD

BACKGROUND OF THE INVENTION

1. Field of the Invention

The present invention relates to a liquid ejection head, an image forming apparatus and a liquid supply method for a liquid ejection head, and more particularly to a liquid ejection head in which high-density arrangement of nozzles can be achieved.

2. Description of the Related Art

There are inkjet recording apparatuses, which record desired images onto recording media by ejecting ink from liquid ejection heads (hereinafter referred to simply as "heads") having a plurality of nozzles. The head has pressure chambers connected with the respective nozzles, and piezoelectric elements corresponding to these pressure chambers, and ink droplets are ejected from the nozzles by applying pressure to the ink inside the pressure chambers by means of the displacement of the piezoelectric elements.

Japanese Patent Application Publication No. 2002-19110, for example, discloses a head composed by layering together an elastic plate having pressure generating devices, a channel forming plate in which a plurality of long and thin pressure chambers (pressure generating chambers) are formed in parallel at a prescribed pitch, a connecting passage forming plate in which nozzle openings are formed in the side end faces, a reservoir forming plate in which a reservoir (common channel) which supplies ink to the respective pressure chambers, and a frame forming plate in which nozzle holes are formed in a row configuration.

Japanese Patent Application Publication No. 7-323541 discloses a head in which a channel forming plate having a plurality of slit-shaped channel holes, which are to be ink channels, formed at prescribed intervals, and a diaphragm made of a piezoelectric material, provided with electrodes opposing the channel holes on both the front and rear surfaces, are layered together alternately and fixed.

Japanese Patent Application Publication No. 2002-178509 discloses a head in which a plurality of piezoelectric bodies, each formed with a plurality of grooves, are layered together.

In recent years, there have been demands for inkjet recording apparatuses to be able to record high-resolution, high-definition images at high speed. For this purpose, it is necessary to arrange the nozzles of the head installed in the apparatus, at high density.

In the heads disclosed in the above-described Japanese Patent Application Publication Nos. 2002-19110, 7-323541 and 2002-178509, it is necessary to increase the number of layered members in order to achieve a high-density arrangement of the nozzles. However, in each of these heads, the ink tank is disposed to one side of the head, and if the number of layered members is increased, then the loss in the channel inside the head rises, and there is a problem in that refilling characteristics deteriorate.

SUMMARY OF THE INVENTION

The present invention has been contrived in view of these circumstances, an object thereof being to provide a liquid ejection head, an image forming apparatus and a liquid supply method for a liquid ejection head, whereby high-density arrangement of nozzles can be achieved, as well as improving refilling characteristics.

In order to attain the aforementioned object, the present invention is directed to a liquid ejection head, comprising: a head main body which is constructed from a plurality of head units layered together in a layering direction perpendicular to a liquid ejection direction of nozzles, each of the head units having the nozzles, pressure chambers connected with the nozzles and arranged in a one-dimensional configuration, and piezoelectric elements corresponding to the pressure chambers and arranged in a one-dimensional configuration, the head main body having through channels substantially parallel to the layering direction of the head units, the through channels being in connection with the pressure chambers; and first and second liquid accommodating chambers which are arranged on sides of the head main body opposing to each other in the layering direction of the head units, the first and second liquid accommodating chambers being in connection with the through channels.

According to this aspect of the present invention, by constructing the head main body from the layers of the head units, it is possible to arrange the pressure chambers and the piezoelectric elements at high density, and therefore it is possible to achieve high-density arrangement of the nozzles. Moreover, since the first and second liquid accommodating chambers are arranged on both sides of the head main body opposing to each other in the layering direction of the head units, then even if the number of the layered head units is increased, it is possible to achieve relatively low channel loss inside the liquid ejection head, and hence refilling characteristics can be improved.

Preferably, the through channels are in connection with the pressure chambers through common channels, each of the head units having at least one of the common channels.

According to this aspect of the present invention, it is possible to reduce cross-talk between mutually adjacent nozzles.

In order to attain the aforementioned object, the present invention is also directed to an image forming apparatus comprising the above-described liquid ejection head.

In order to attain the aforementioned object, the present invention is also directed to a liquid supply method for a liquid ejection head which comprises: a head main body which is constructed from a plurality of head units layered together in a layering direction perpendicular to a liquid ejection direction of nozzles, each of the head units having the nozzles, pressure chambers connected with the nozzles and arranged in a one-dimensional configuration, and piezoelectric elements corresponding to the pressure chambers and arranged in a one-dimensional configuration, the head main body having through channels substantially parallel to the layering direction of the head units, the through channels being in connection with the pressure chambers; and first and second liquid accommodating chambers which are arranged on sides of the head main body opposing to each other in the layering direction of the head units, the first and second liquid accommodating chambers being in connection with the through channels, the liquid supply method comprising the step of: supplying liquid to the first and second liquid accommodating chambers in a state where the layering direction of the head units is substantially vertical.

According to this aspect of the present invention, it is possible to improve air bubble removal characteristics when supplying the liquid to the liquid ejection head.

According to the present invention, by laminating the head main body from the plurality of head units, it is possible to arrange the pressure chambers and the piezoelectric elements at high density, and therefore it is possible to achieve high-density arrangement of the nozzles. Moreover, since the first and second liquid accommodating chambers are disposed on sides of the head main body in the layering direction of the head units, then even if the number of layered head units is increased, it is possible to achieve relatively low channel loss inside the liquid ejection head, and hence refilling characteristics can be improved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

First Embodiment

Figure 1:
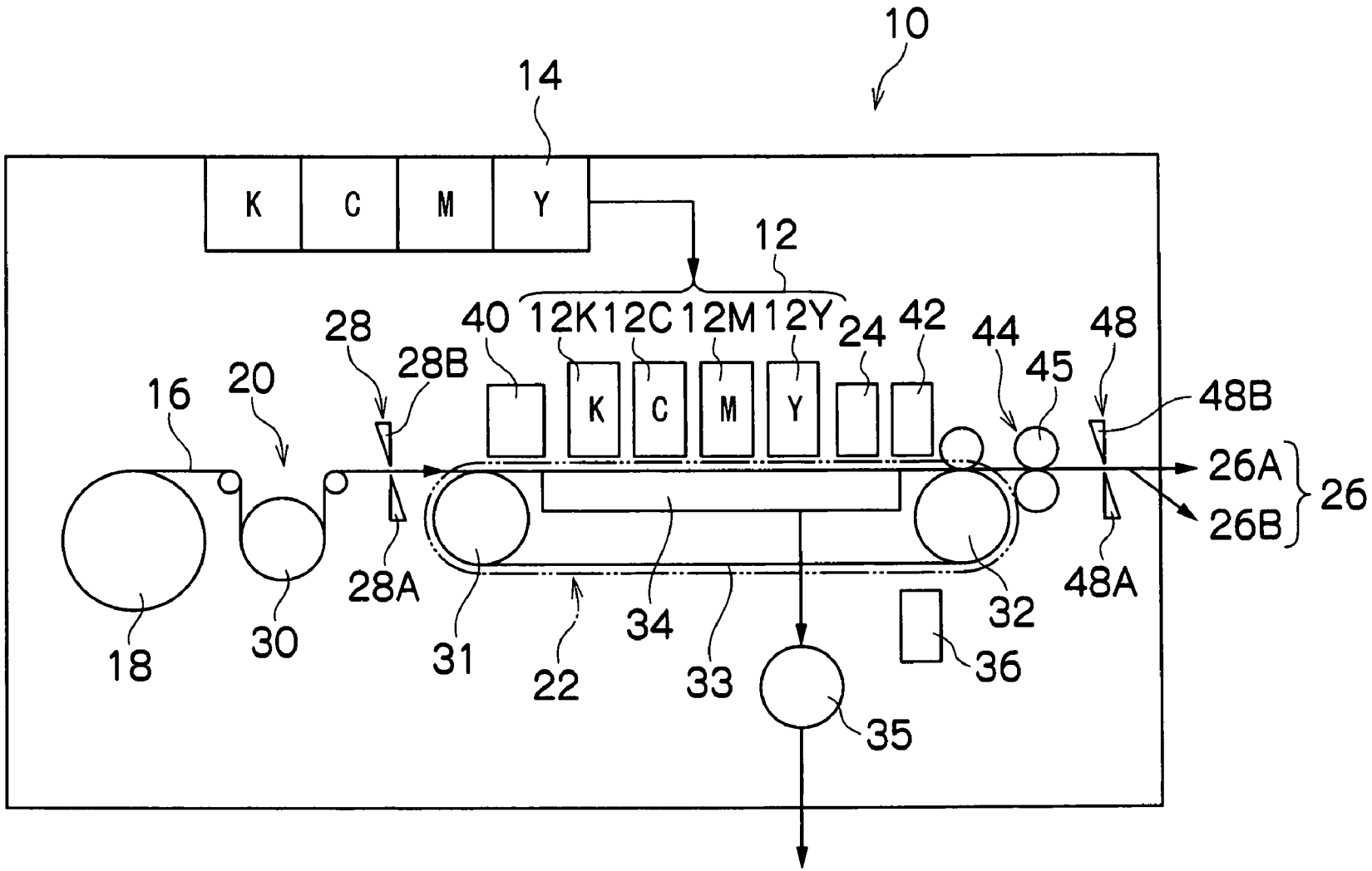
FIG. 1 is a general schematic drawing of an inkjet recording apparatus according to an embodiment of the present invention.

An inkjet recording apparatus as an image forming apparatus according to an embodiment the present invention is described. FIG. 1 is a diagram of the general composition of the inkjet recording apparatus. As shown in FIG. 1, the inkjet recording apparatus 10 comprises: a printing unit 12 having a plurality of heads (liquid ejection heads) 12K, 12C, 12M, and 12Y for ink colors of black (K), cyan (C), magenta (M), and yellow (Y), respectively; an ink storing and loading unit 14 for storing inks of K, C, M and Y to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet ejection face) of the print unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, whose length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used (type of medium) is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a flat plane.

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt 33 is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can have a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The print unit 12 is a so-called "full line head" in which a line head having a length corresponding to the maximum paper width is arranged in a direction (main scanning direction) that is perpendicular to the paper conveyance direction (sub-scanning direction). Each of the heads 12K, 12C, 12M, and 12Y constituting the print unit 12 is constituted by a line head, in which a plurality of ink ejection ports (nozzles) are arranged along a length that exceeds at least one side of the maximum-size recording paper 16 intended for use in the inkjet recording apparatus 10.

The heads 12K, 12C, 12M, and 12Y are arranged in the order of black (K), cyan (C), magenta (M), and yellow (Y) from the upstream side (the left-hand side in FIG. 1), along the conveyance direction of the recording paper 16 (paper conveyance direction). A color image can be formed on the recording paper 16 by ejecting the inks from the heads 12K, 12C, 12M, and 12Y, respectively, onto the recording paper 16 while conveying the recording paper 16.

The print unit 12, in which the full-line heads covering the entire width of the paper are thus provided for the respective ink colors, can record an image over the entire surface of the recording paper 16 by performing the action of moving the recording paper 16 and the print unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a head moves reciprocally in a direction (main scanning direction) which is perpendicular to the paper conveyance direction.

Although the configuration with the KCMY four standard colors is described in the present embodiment, combinations of the ink colors and the number of colors are not limited to those. Light inks or dark inks can be added as required. For example, a configuration is possible in which heads for ejecting light-colored inks such as light cyan and light magenta are added.

As shown in FIG. 1, the ink storing and loading unit 14 has ink tanks for storing the inks of the colors corresponding to the respective heads 12K, 12C, 12M, and 12Y, and the respective tanks are connected with the heads 12K, 12C, 12M, and 12Y by means of channels (not shown). The ink storing and loading unit 14 has a warning device (for example, a display device or an alarm sound generator) for warning when the remaining amount of any ink is low, and has a mechanism for preventing loading errors among the colors.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern image printed by the heads 12K, 12C, 12M, and 12Y for the respective colors, and the ejection of each head is determined. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B. Although not shown in the drawings, the paper output unit 26A for the target prints is provided with a sorter for collecting prints according to print orders.

Next, the structure of the heads 12K, 12C, 12M, 12Y is described. The heads 12K, 12C, 12M and 12Y of the respective ink colors have the same structure, and a reference numeral 50 hereinafter denotes any of the heads.

Figure 2:
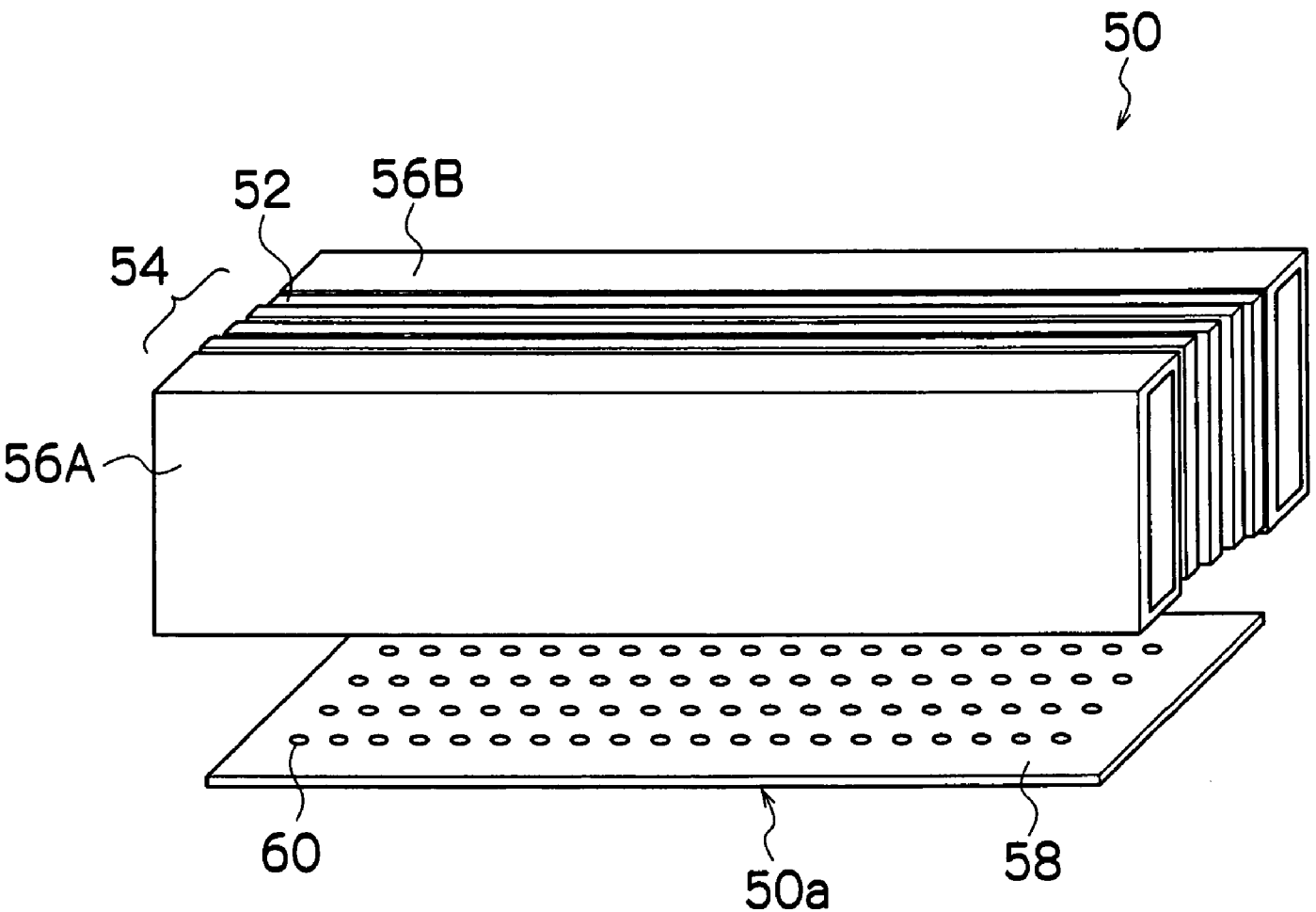
FIG. 2 is an external oblique diagram of a head according to a first embodiment.

FIG. 2 is an external perspective diagram of the head 50. The head 50 shown in FIG. 2 principally comprises: a head main body 54 laminated from a plurality of head units 52; ink tanks (liquid accommodating chambers) 56A and 56B arranged on sides of the head main body 54 in the layering direction of the head units 52; and a nozzle plate 58 constituting a nozzle surface (ink ejection surface) 50*a* of the head 50, which is bonded to one side face of the head main body 54 situated in parallel with the layering direction of the head units 52. A plurality of nozzles 60 are formed in the nozzle plate 58. There is also a mode in which the nozzles 60 are formed directly in one side face of each of the head units 52.

Figure 3:
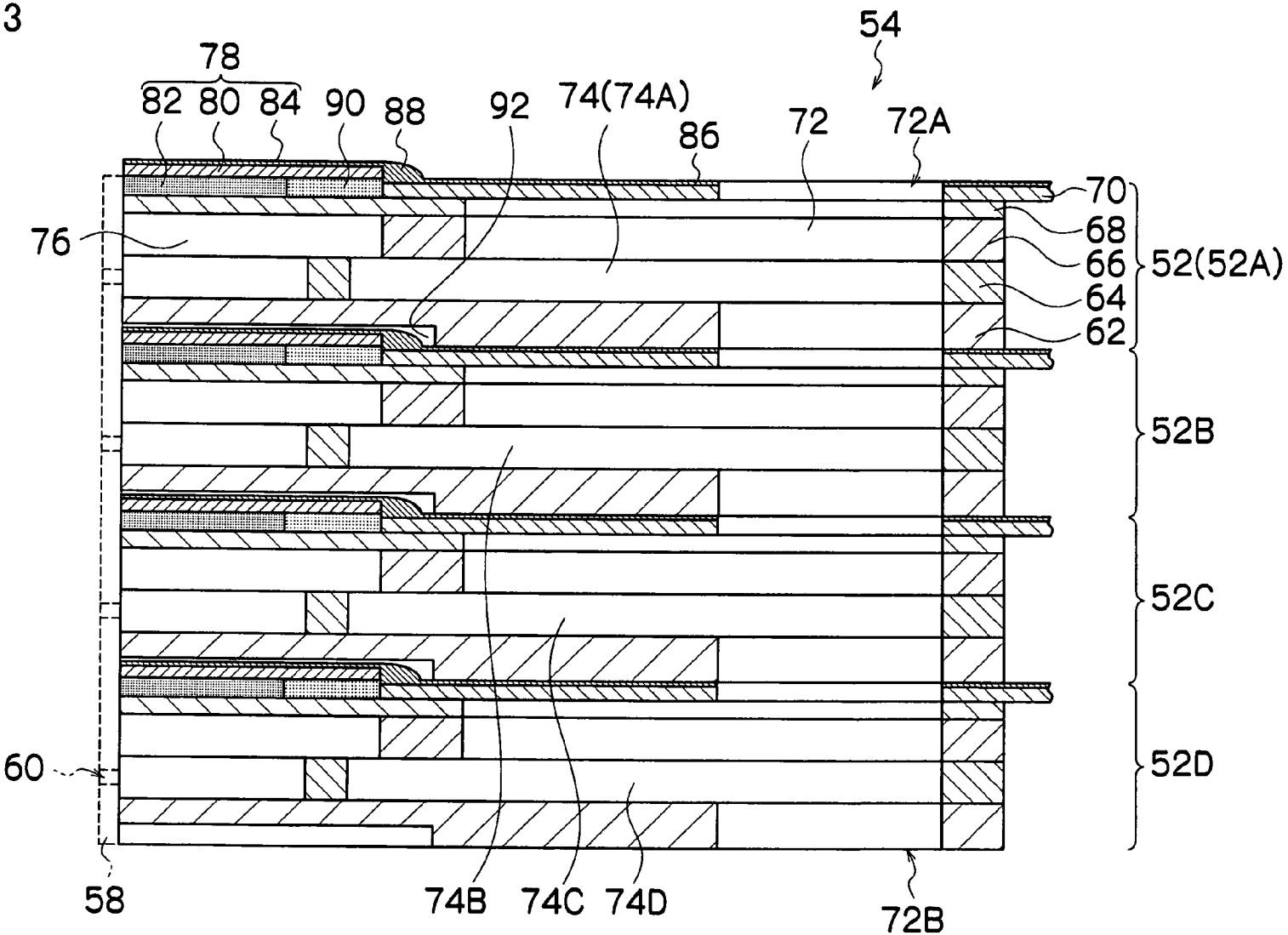
FIG. 3 is a cross-sectional diagram of the main body of the head.

FIG. 3 is a cross-sectional side view diagram of the head main body 54. As shown in FIG. 3, the head main body 54 is constructed of the plurality of head units 52 bonded together. In this embodiment, a composition in which four head units (52A to 52D) are layered is shown as an example, but the number of layered head units 52 is not limited in particular to the present embodiment. The layering direction of the head units 52 (the vertical direction in FIG. 3) is perpendicular to the direction of ink ejection from the nozzles 60, which are drawn with the dotted lines in FIG. 3. Each of the head units 52 is laminated from a plurality of channel forming plates 62 to 70, in the layering direction of the head units 52 (the vertical direction in FIG. 3).

A through channel 72 is formed which passes through the head main body 54 in the layering direction of the head units 52. The through channel 72 is in connection with the respective pressure chambers 76 through rear-side channels (common channels) 74 (74A to 74D) provided for the respective head units 52. Each of the rear-side channels 74 is formed so as to cover the region corresponding to the pressure chambers 76 arranged following the depth direction in terms of the plane of the drawing in FIG. 3, and each of the rear-side channels 74 is in connection with all of the pressure chambers 76 in the corresponding one of the head units 52. The upper and lower ends of the through channel 72 form opening sections 72A and 72B, which are in connection with the ink tanks 56A and 56B in FIG. 2, respectively, and the ink inside the ink tanks 56A and 56B can be supplied to the pressure chambers 76 through the channels 72 and 74.

The pressure chambers 76 are open on one side face (the left-hand side face in FIG. 3) of the head units 52 which the face is parallel to the layering direction of the head units 52. The nozzle plate 58, which is drawn with the dotted lines in FIG. 3, is registered in position in such a manner that the nozzles 60 are in connection with the pressure chambers 76, and is then bonded.

One wall (the upper wall in FIG. 3) of the pressure chamber 76 is constituted by a fourth channel forming plate (diaphragm) 68, and piezoelectric elements 78 are arranged on the fourth channel forming plate 68 at positions corresponding to the pressure chambers 76. Each of the piezoelectric elements 78 has a structure in which a lower electrode (common electrode) 82 and an upper electrode (individual electrode) 84 are disposed on a thin film-shaped piezoelectric body 80. The common electrode 82 is grounded, and the individual electrode 84 is connected through an electrical connection section 88 to a wire 86 for applying drive signals. The wire 86 is formed on a fifth channel forming plate (wiring substrate) 70. For example, a conductive adhesive, or the like, is used for the electrical connection section 88. An insulating member 90 is arranged beside the common electrode 82.

Dead-end grooves 92 are formed on a first channel forming plate (piezoelectric element cover) 62 at positions corresponding to the piezoelectric elements 78. The dead-end grooves 92 are open on the side opposite to the side of a second channel forming plate 64. As shown in FIG. 3, the piezoelectric elements 78 of another, adjacent head unit 52 are accommodated inside the dead-end grooves 92 (e.g., the piezoelectric elements 78 of the head unit 52B are accommodated inside the dead-end grooves 92 of the head unit 52A), when the head units 52 are layered together. The dead-end grooves 92 are formed in such a manner that a prescribed displacement space is ensured in the peripheral area of the piezoelectric elements 78, thereby preventing constriction of the displacement of the piezoelectric elements 78.

By adopting the above-described composition, when a drive signal (drive voltage) is applied to the piezoelectric element 78, the ink inside the pressure chamber 76 is pressurized due to the displacement of the piezoelectric element 78, and a droplet of the ink is ejected from the nozzle 60 connected with the pressure chamber 76.

Next, the composition of the channel forming plates 62 to 70 is described. FIGS. 4A to 4E show plan diagrams of the respective channel forming plates 62 to 70.

Figure 4A:
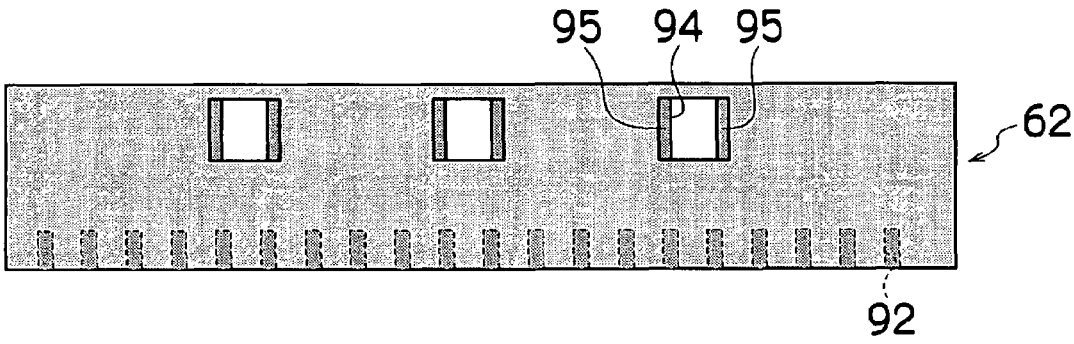
FIGS. 4A to 4E are plan diagrams of channel forming plates.

The first channel forming plate (piezoelectric element cover) 62 is a thin plate member having a thickness of 100 μm. As shown in FIG. 4A, the first channel forming plate 62 has the plurality of dead-end grooves 92 arranged following the longer edge, and a plurality of square-shaped apertures 94 constituting parts of the respective through channels 72 (see FIG. 3). Moreover, the first channel forming plate 62 is provided with column-shaped supporting members 95 having a height of 190 μm to 195 μm arranged on both the left-hand side and the right-hand side of each aperture 94. The supporting members 95 are formed in such a manner that they pass through the rear-side channels 74 and support the fifth channel forming plate (wiring substrate) 70.

Figure 4B:
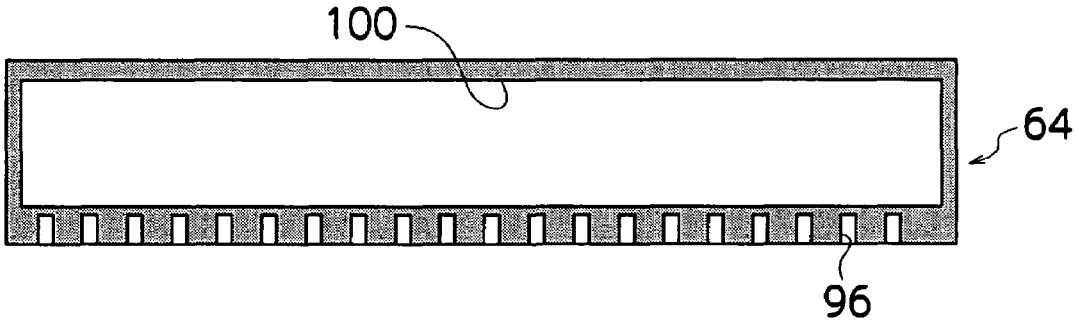
Figure 4C:
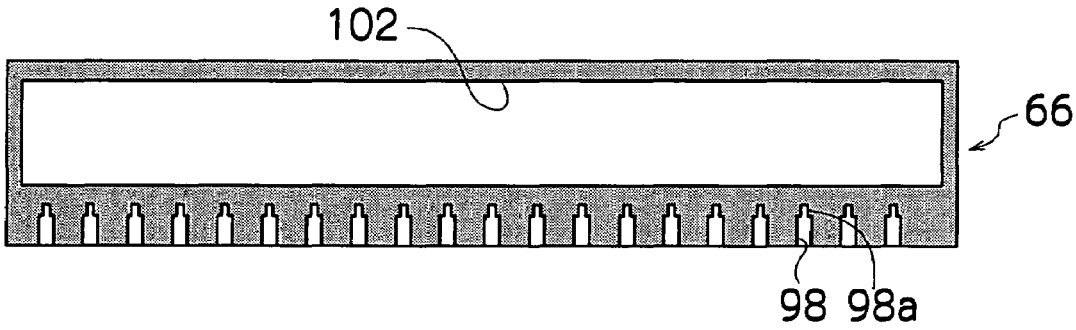

The second and third channel forming plates 64 and 66 are thin plate members having thicknesses of 80 μm and 100 μm, respectively. As shown in FIGS. 4B and 4C, the second and third channel forming plates 64 and 66 have a plurality of apertures 96 and 98 arranged following the longer edges, and apertures 100 and 102 arranged along sides of the rows of the apertures 96 and 98. The apertures 96 and 98 constitute parts of the pressure chambers 76, and the apertures 100 and 102 constitute parts of the through channels 72 and the rear-side channels 74 (see FIG. 3). The shorter dimension of the aperture 100 is slightly wider than the aperture 102 so that, in a state where the second and third channel forming plates 64 and 66 are layered together, end sections 98*a* of the apertures 98 in the third channel forming plate 66 overlap with the aperture 100 in the second channel forming plate 64. Hence, as shown in FIG. 3, the respective pressure chambers 76 are connected with the rear-side channel 74.

Figure 4D:
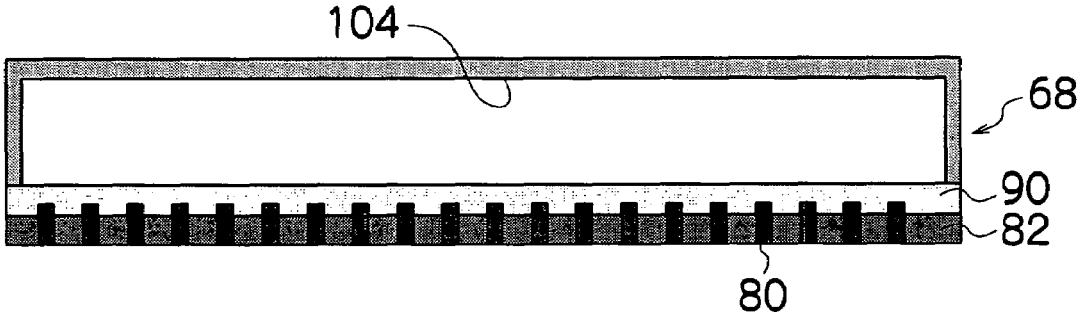

The fourth channel forming plate (diaphragm) 68 is a thin plate member having a thickness of 10 μm to 15 μm. As shown in FIG. 4D, the fourth channel forming plate 68 has an aperture 104 constituting a part of the through channel 72 and having substantially the same size as the aperture 102 in the third channel forming plate 68. Moreover, the fourth channel forming plate 68 is provided with the common electrode 82 and the insulating members 90 arranged following the longer edge, and the plurality of thin film-shaped piezoelectric bodies 80 arranged on the common electrode 82. The piezoelectric bodies 80 have a thickness of 10 μm to 15 μm.

Figure 4E:
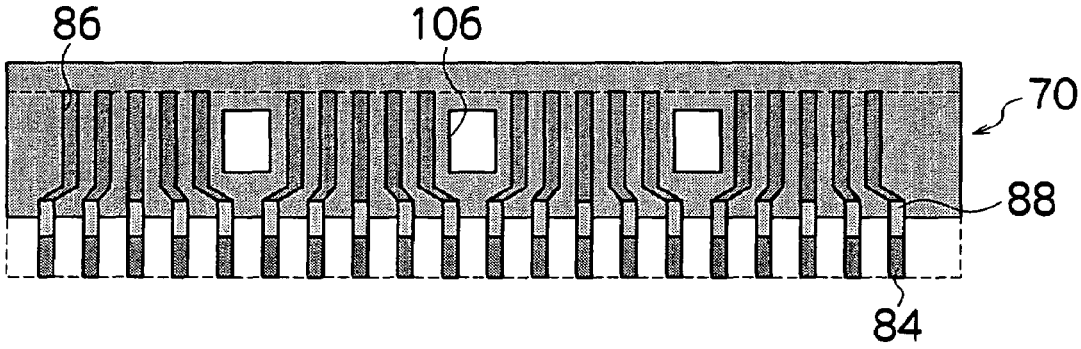

The fifth channel forming plate (wiring substrate) 70 is the flexible printed circuit (FPC) having a thickness of 25 μm. As shown in FIG. 4E, the fifth channel forming plate 70 has a plurality of apertures 106 constituting parts of the through channel 72. Moreover, the fifth channel forming plate 70 is provided with the wires 86 in the same number as the number of the piezoelectric elements 78 (in other words, the number of the nozzles 60), on the regions on the fifth channel forming plate 70 apart from the apertures 106. The individual electrodes 84 are connected with ends of the wires 86 through the electrical connection sections 88. As shown in FIG. 3, the individual electrodes 84 are each bonded to the upper faces of the piezoelectric bodies 80.

The head 50 according to the first embodiment is thus constructed from the layers of the plurality of head units 52, each of which has the pressure chambers 76 and the piezoelectric elements 78 each arranged in one-dimensional configurations along the direction perpendicular to the ink ejection direction. Hence, it is possible to arrange the pressure chambers 76 and the piezoelectric elements 78 at high density, and the high-density arrangement of the nozzles 60 can be achieved.

In particular, since the piezoelectric elements 78 are constituted by the thin plate-shaped piezoelectric bodies 80, then it is possible to arrange the piezoelectric elements 78 at high density in the layering direction of the head units, which is parallel to the thickness direction of the piezoelectric bodies 80 (see FIG. 3). Moreover, the head 50 has the structure in which the piezoelectric bodies 80 can expand readily in the direction parallel to the ink ejection direction in order to obtain desired ejection force, and hence the head 50 having excellent ejection characteristics can be achieved. Further, it is also possible to reduce the head size in the thickness direction of the piezoelectric bodies 80 (the layering direction of the head units 52), and it is also possible to improve the deposition accuracy of the ink droplets ejected from the nozzles 60 on the recording medium.

Furthermore, since the ink tanks 56A and 56B are disposed on the respective sides of the head main body 54, then even if the number of layered head units 52 is increased, it is possible to achieve relatively low channel loss inside the head 50, and hence refilling characteristics can be improved.

Moreover, since the through channels 72 in the head main body 54 are connected to the pressure chambers 76 through the rear-side channels 74 provided for the respective head units 52, then it is possible to reduce cross-talk between adjacent nozzles in comparison with a mode such as a second embodiment described later where each through channel 72 is shared directly by a plurality of pressure chambers 76. Furthermore, since the fifth channel forming plate (wiring substrate) 70 constituting one wall of the rear-side channel 74 performs a damping function that reduces the pressure wave propagating inside the rear-side channel 74, then it is possible to reduce cross-talk more effectively.

Next, the method of initially filling ink into the head 50 is described.

Figure 5:
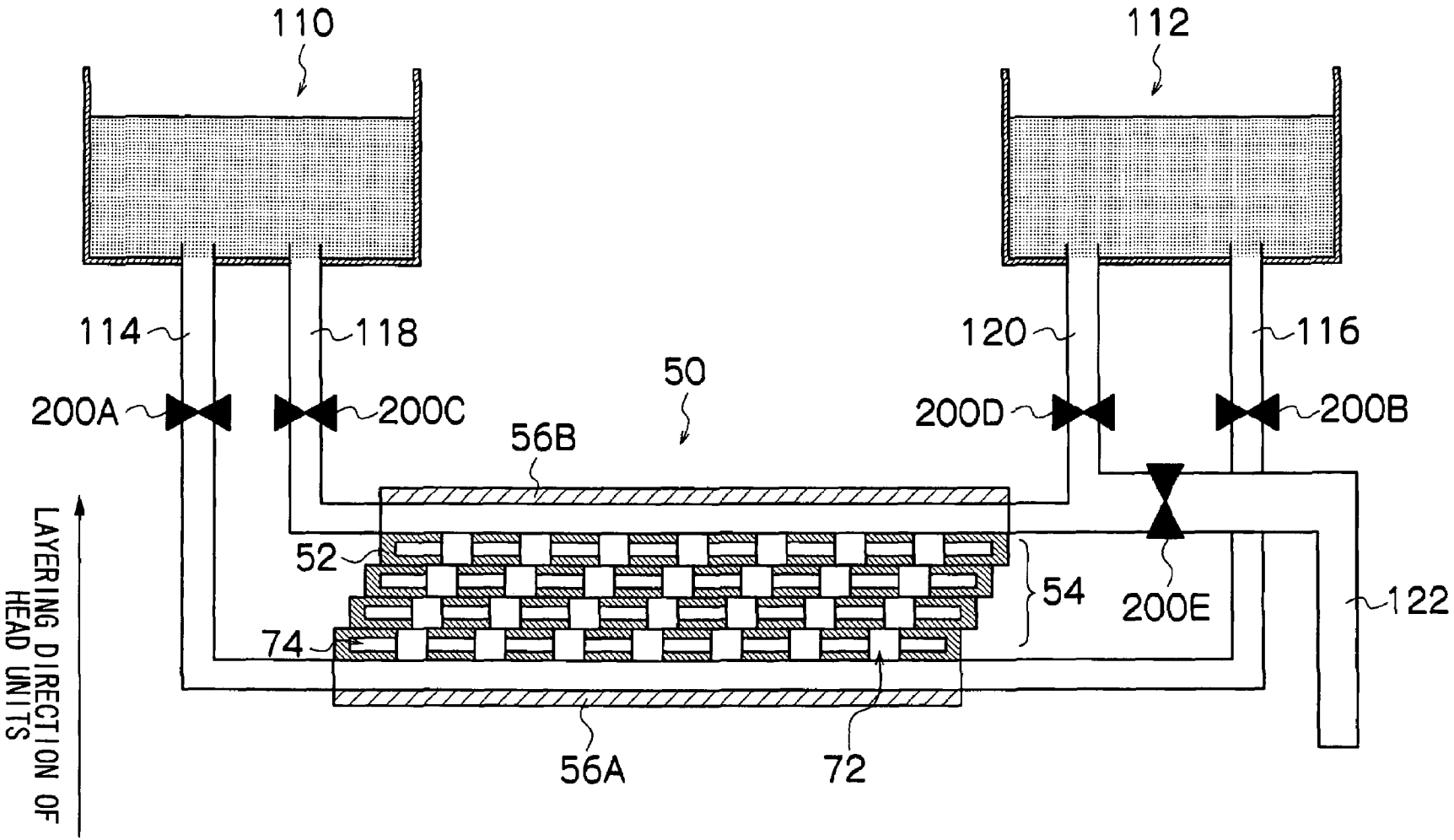
FIG. 5 is a schematic drawing of an ink supply system.

FIG. 5 is a compositional diagram of the ink supply system in the inkjet recording apparatus 10. In FIG. 5, the head 50 is shown in a sectional view taken on a plane parallel with the nozzle plate 58 (not shown in FIG. 5), in order that the arrangement of the through channels 72, the rear-side channels 74 and the ink tanks 56A and 56B can be understood. FIG. 5 shows a case where the head main body 54 is provided with seven through channels 72 and four rear-side channels 74.

The initial ink filling is carried out in a state where the layering direction of the head units 52 in the head 50 is vertical as shown in FIG. 5. In other words, the initial ink filling is carried out in a state where the ink tanks 56A and 56B disposed on the respective sides of the head main body 54 are positioned at the upper and lower sides of the head 50. In the present embodiment, the ink ejection operation is carried out in a state where the nozzle surface 50*a* of the head 50 faces in the downward vertical direction (in other words, in a state where the layering direction of the head units 52 is horizontal) as shown in FIG. 2. Hence, steps for changing the orientation of the head 50 are required before the start of the initial ink filling and after the end of same. The turning mechanism of the head 50 is described later.

First and second external tanks 110 and 112 are used for the initial filling of the ink. The ink to be supplied to the head 50 is held in the external tanks 110 and 112. The initial ink filling is carried out by utilizing the pressure differential between the head 50 and the external tanks 110 and 112, then the positions of the external tanks 110 and 112 (or the heights of the liquid surfaces in the external tanks 110 and 112) are adjusted in such a manner that the liquid surfaces in the external tanks 110 and 112 are situated above the upper surface of the head 50 in the vertical direction.

The left-hand end of the ink tank 56A on the lower side of the head 50 is connected with the first external tank 110 through a first supply channel 114, and the right-hand end thereof is connected with the second external tank 112 through a second supply channel 116. The supply channels 114 and 116A are provided with a first valve 200A and a second valve 200B, respectively. On the other hand, the left-hand end of the ink tank 56B on the upper side of the head 50 is connected with the first external tank 110 through a third supply channel 118, and the right-hand end thereof is connected with the second external tank 112 through a fourth supply channel 120. Similarly to the other supply channels 114 and 116, the supply channels 118 and 120 are provided with a third valve 200C and a fourth valve 200D, respectively. Moreover, a discharge channel 122 branches off from the fourth supply channel 120 between the ink tank 56B and the fourth valve 200D. The discharge channel 122 is provided with a fifth valve 200E. Before the start of the initial ink filling, all the valves 200A to 200E are closed as shown in FIG. 5. In the drawings, the valve in the closed state (e.g., the valve 200A in FIG. 5) is represented with the solid triangles, and the valve in the open state (e.g., the valve 200A in FIG. 6A) is represented with the outlined triangles.

The initial ink filling is carried out in the following manner by means of the above-described ink supply system.

Figures 6A, 6B, 6C, 6D:
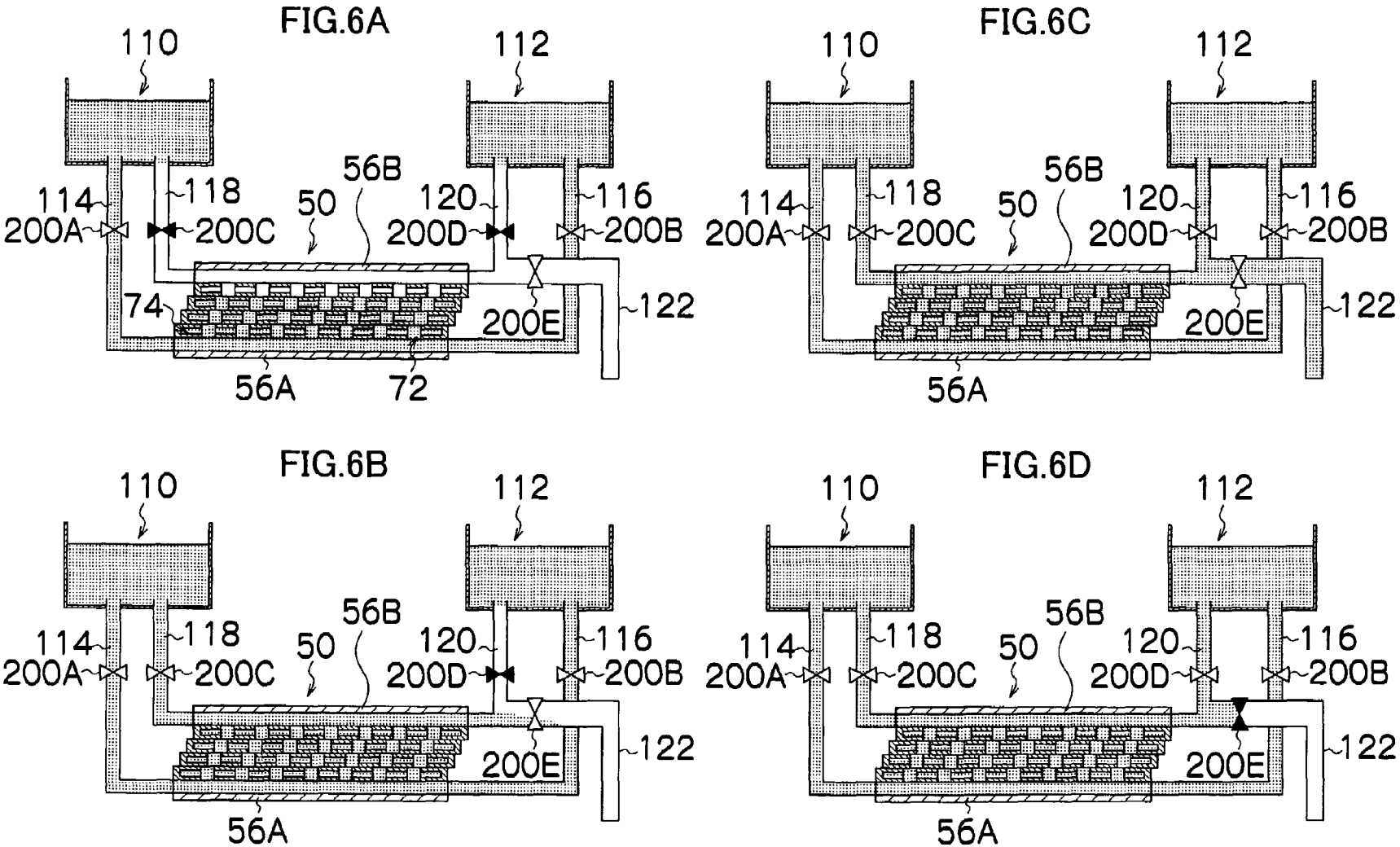
FIGS. 6A to 6D are illustrative diagrams showing an initial ink filling method.

Firstly, the head 50 is oriented in such a manner that the layering direction of the head units 52 lies in the vertical direction, and then the first, second and fifth valves 200A, 200B and 200E are opened as shown in FIG. 6A. Thereby, the ink in the first and second external tanks 110 and 112 is supplied to the ink tank 56A on the lower side of the head 50 through the first and second supply channels 114 and 116, and furthermore, the ink is supplied to the rear-side channels 74 of the head main body 54 through the through channels 72. In this process, since the ink is supplied gradually from the lower side toward the upper side of the head 50, then air bubbles inside the head 50 move toward the upper side of the head 50, and the air bubbles ultimately move into the ink tank 56B.

Thereupon, as shown in FIG. 6B, the third valve 200C is opened. Thereby, the ink in the first external tank 110 is supplied to the ink tank 56B on the upper side of the head 50 through the third supply channel 118. The surplus ink is discharged from the ink tank 56B through the discharge channel 122, which branches from the fourth supply channel 120 on the right-hand end of the ink tank 56B. In this process, the air bubbles having remained inside the ink tank 56B are discharged from the right-hand end of the ink tank 56B along with the surplus ink.

Thereupon, as shown in FIG. 6C, the fourth valve 200D is opened. Thereby, the ink flows inside the fourth supply channel 120 from the second external tank 112 toward the ink tank 56B. As shown in FIGS. 6A to 6D, the discharge channel 122 is formed to have a larger cross-sectional surface area in comparison with the fourth supply channel 120, in such a manner that the channel resistance of the discharge channel 122 is smaller than the fourth supply channel 120. Hence, the ink flowing inside the fourth supply channel 120 does not flow toward the ink tank 56B, but is discharged into the discharge channel 122 along with the above-described surplus ink. Therefore, the air bubbles that have been discharged from the ink tank 56B and remained inside the fourth supply channel 120 are discharged toward the discharge channel 122.

Finally, the initial ink filling is completed by closing the fifth valve 200E as shown in FIG. 6D. By opening and closing the valves 200A to 200E in the prescribed sequence in the state where the head 50 has been oriented in such a manner that the ink tanks 56A and 56B are positioned at the upper and lower sides of the head 50, it is possible to carry out the initial ink filling with good efficiency, without leaving air bubbles inside the head 50, or inside the supply channels 114, 116, 118 and 120, either.

Figure 7:
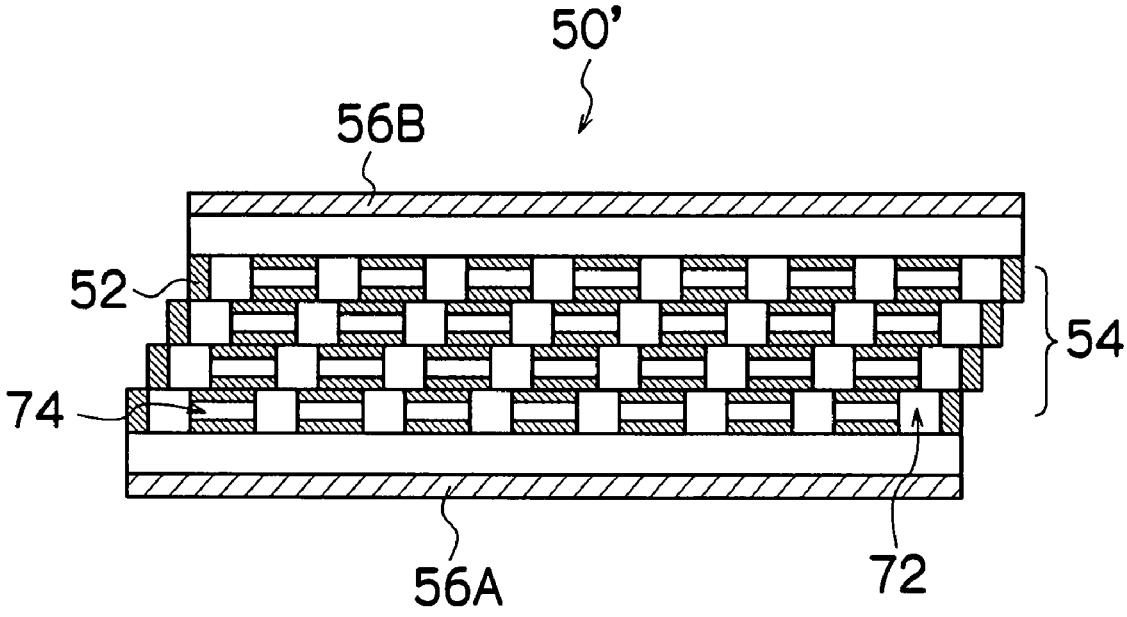
FIG. 7 is a cross-sectional diagram showing a further example of the head according to the first embodiment.

When performing the initial ink filling by means of the above-described method, it is more desirable to use a head 50' shown in FIG. 7. In this head 50', the right-hand end and the left-hand end of each head unit 52 do not have the dead-end shape as in the head 50 in FIG. 5. Instead, the through channels 72 are disposed at both ends of the head units 52 in the lengthwise direction thereof, and therefore it is possible to remove air bubbles more effectively during the initial ink filling.

Figure 8A:
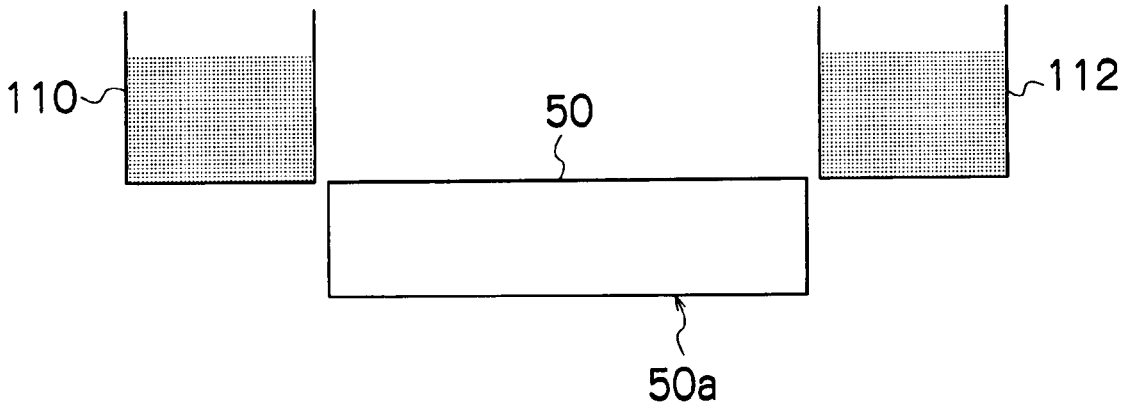
FIGS. 8A and 8B are schematic drawings showing the relationship between external tanks and the head.
Figure 8B:
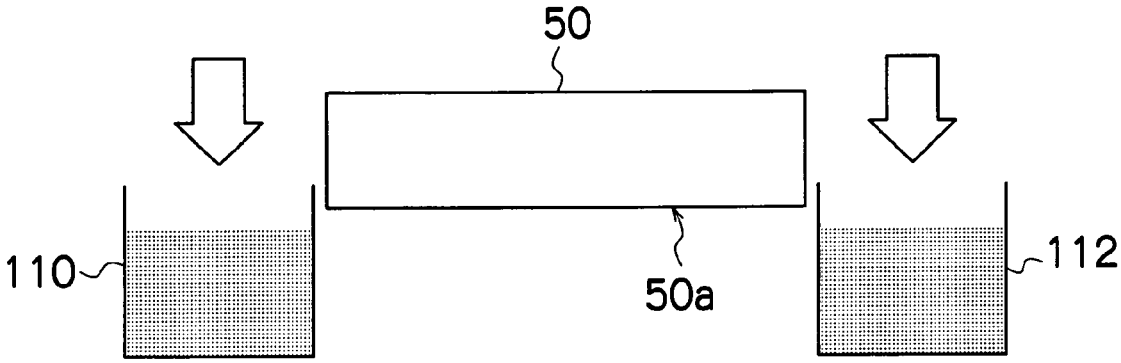

FIG. 8A is a schematic drawing showing a simplified view of a situation where the orientation of the head 50 has been returned to the original state, in which the nozzle surface 50*a* is facing in the downward vertical direction, after completion of the initial ink filling. The supply channels connecting the head 50 with the external tanks 110 and 112, and the like, are omitted from this drawing. As shown in FIG. 8A, if the liquid surfaces in the external tanks 110 and 112 are situated above the nozzle surface 50*a* in the vertical direction, then a positive pressure is applied to the interior of the head 50 at all times, and therefore it is difficult to maintain the appropriate positions of the liquid surfaces in the nozzles. Hence, the external tanks 110 and 112 are made capable of vertically moving, and when an ink ejection operation is carried out, then it is desirable to change the positions of the external tanks 110 and 112 in such a manner that the liquid surfaces in the external tanks 110 and 112 are lower than the nozzle surface 50*a* in the vertical direction as shown in FIG. 8B. It is thereby possible to set the interior of the head 50 to a negative pressure, and the appropriate positions of the liquid surfaces in the nozzles can be maintained.

Figure 9A:
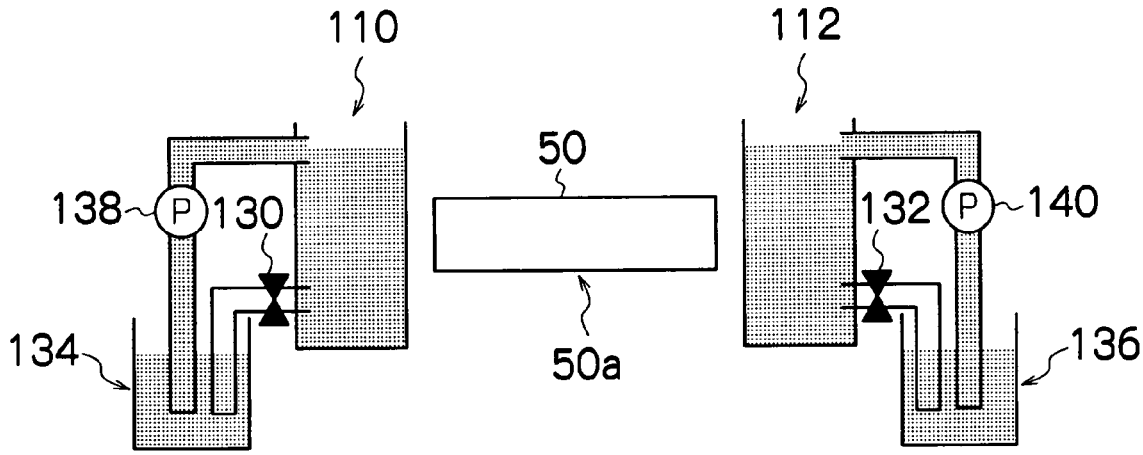
FIGS. 9A and 9B are illustrative diagrams showing a method of adjusting the liquid surfaces in the external tanks.
Figure 9B:
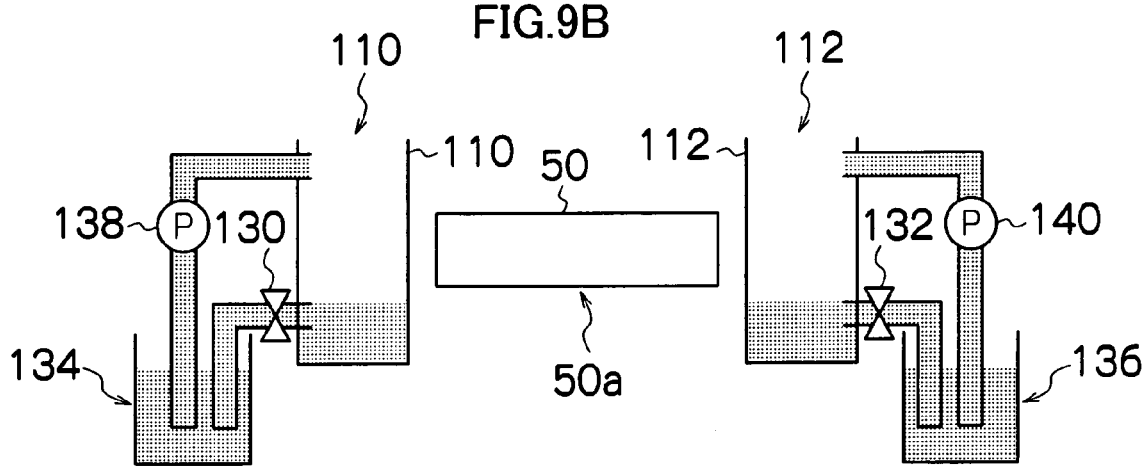

Furthermore, it is also desirable that the external tanks 110 and 112 are provided with valves 130 and 132 and pumps 138 and 140 for adjusting the liquid surfaces as shown in FIG. 9A. When an ink ejection operation is carried out, the valves 130 and 132 are opened as shown in FIG. 9B, thereby the ink inside the external tanks 110 and 112 is discharged to the recovery tanks 134 and 136, and thus the liquid surfaces in the external tanks 110 and 112 are adjusted in such a manner that the liquid surfaces in the external tanks 110 and 112 are below the nozzle surface 50*a* in the vertical direction. When carrying out the initial ink filling again, the valves 130 and 132 are closed as shown in FIG. 9A and the pumps 138 and 140 are driven, thereby the ink inside the recovery tanks 134 and 136 is supplied to the external tanks 110 and 112, and thus the liquid surfaces in the external tanks 110 and 112 are adjusted in such a manner that the liquid surfaces in the external tanks 110 and 112 are above the upper surface of the head 50 in the vertical direction. By adjusting the liquid surfaces in the external tanks 110 and 112 in this way, it is possible to set the interior of the head 50 to a negative pressure during the ink ejection operation, and the appropriate positions of the liquid surfaces in the nozzles can be maintained.

Figure 10A:
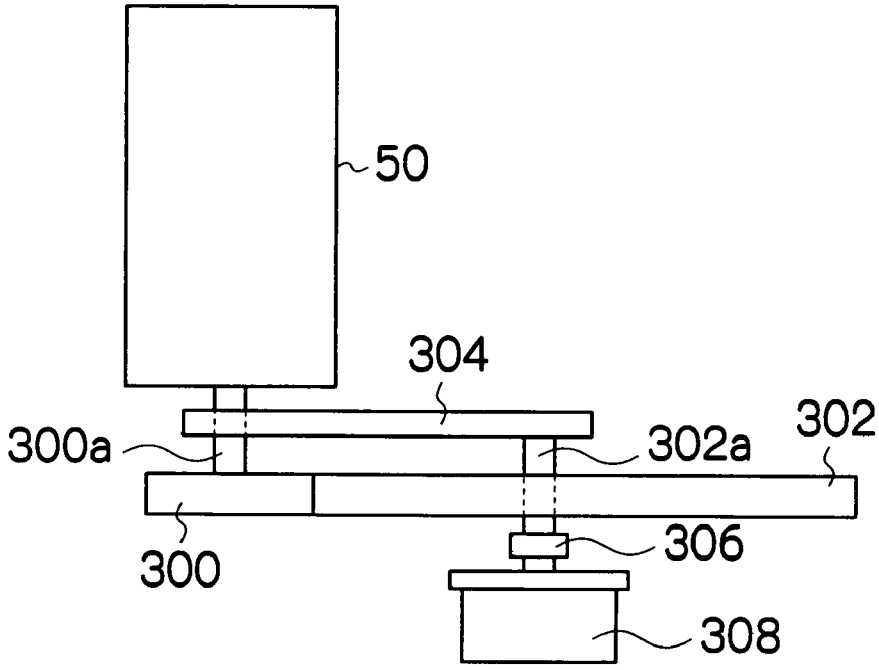
FIGS. 10A and 10B are general schematic drawings showing a turning mechanism of the head.
Figure 10B:
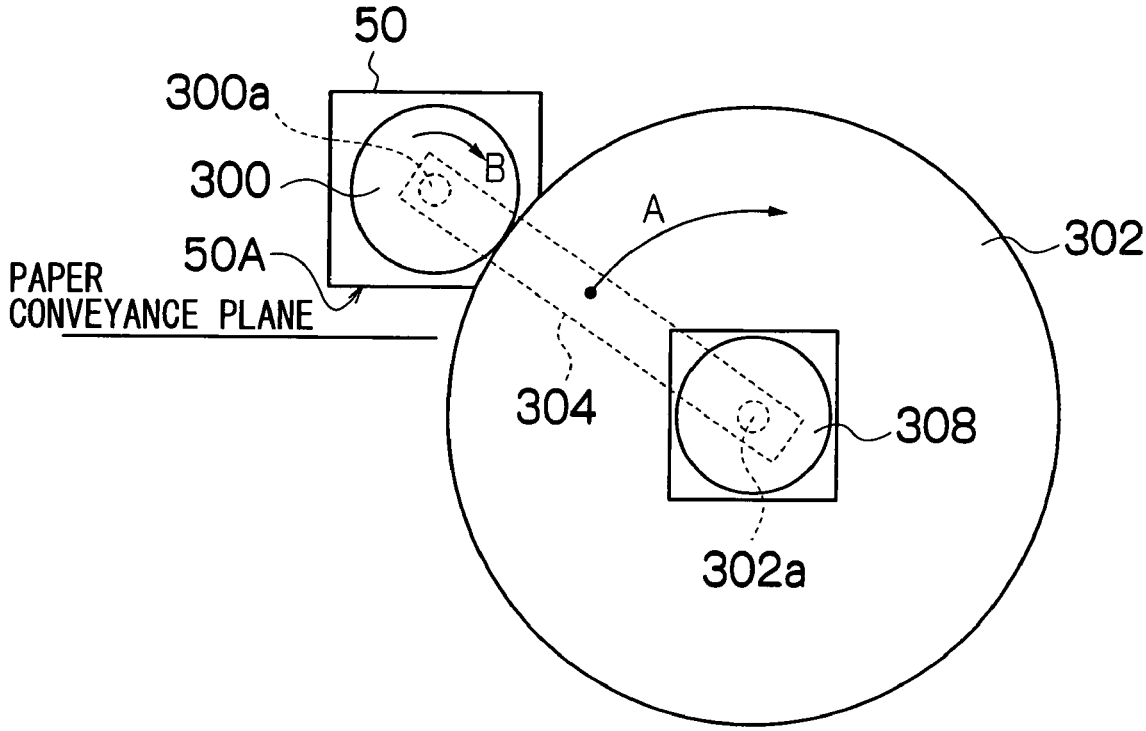

Next, the turning mechanism of the head 50 is described. FIGS. 10A and 10B are general schematic diagrams showing the turning mechanism of the head 50, wherein FIG. 10A is a plan diagram and FIG. 10B is a front diagram. As shown in FIGS. 10A and 10B, a first gear 300 and a second gear 302 engage with each other, and shafts 300*a* and 302*a* of these gears are connected with each other through a link 304. The first gear 300 is fixed and connected with the head 50 through the shaft 300*a*. On the other hand, the shaft 302*a* on the link 304 is connected with a motor 308 through a coupling 306.

The positions of the shaft 302*a* and the second gear 302 are fixed, and when the link 304 is turned in the direction of arrow A by driving the motor 308, the first gear 300 turns in the direction of arrow B, and the orientation of the head 50 is changed while withdrawing the head 50 from the paper conveyance plane. If the head 50 is turned while its location is unchanged, then there is a risk that the head 50 interferes with the paper conveyance plane. Hence, it is beneficial to thus withdraw the head 50 from the paper conveyance plane when turning the head 50.

In the present embodiment, the initial ink filling is carried out after turning the orientation of the nozzle surface 50*a* through 90 degrees by means of the turning mechanism, in such a manner that the nozzle surface 50*a* of the head 50 moves from the vertical downward facing state to the state facing in the horizontal direction. Furthermore, after completing the initial ink filling, the orientation of the nozzle surface 50*a* is returned to its original state, similarly by means of the turning mechanism, in such a manner that the nozzle surface 50*a* of the head 50 faces vertically downwards.

Second Embodiment

Next, a second embodiment of the present invention is described. Below, the parts of the second embodiment that are common to the above-described first embodiment are not described, and the explanation focuses on the characteristic features of the second embodiment.

Figure 11:
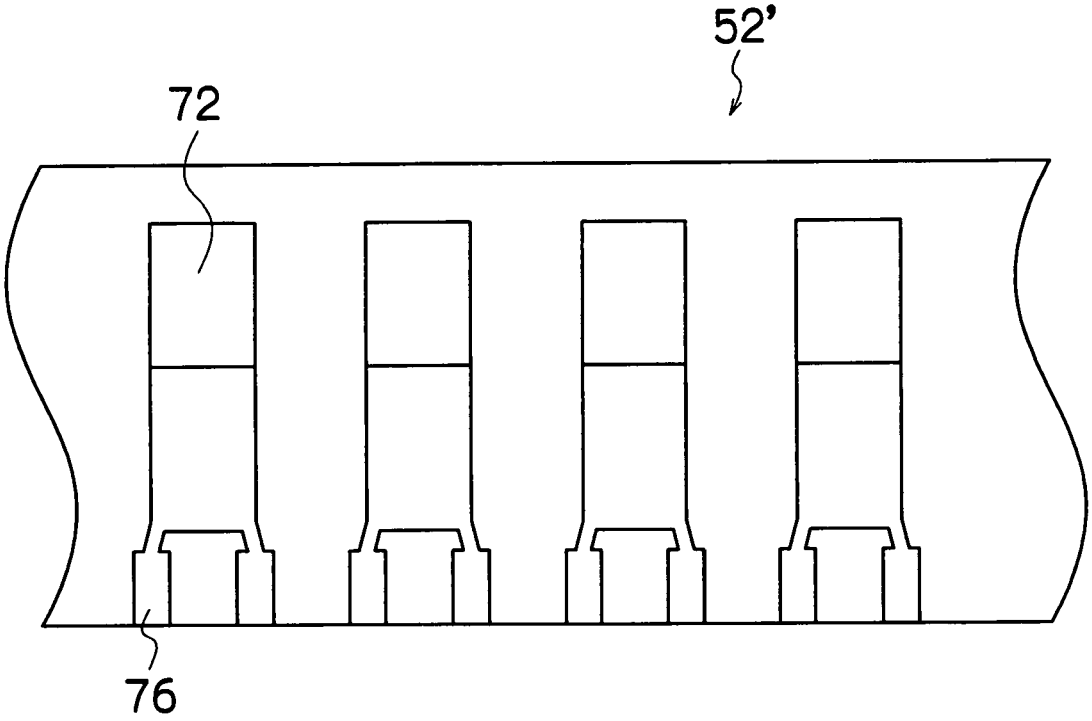
FIG. 11 is a plan view perspective diagram of a head unit according to a second embodiment.
Figure 12:
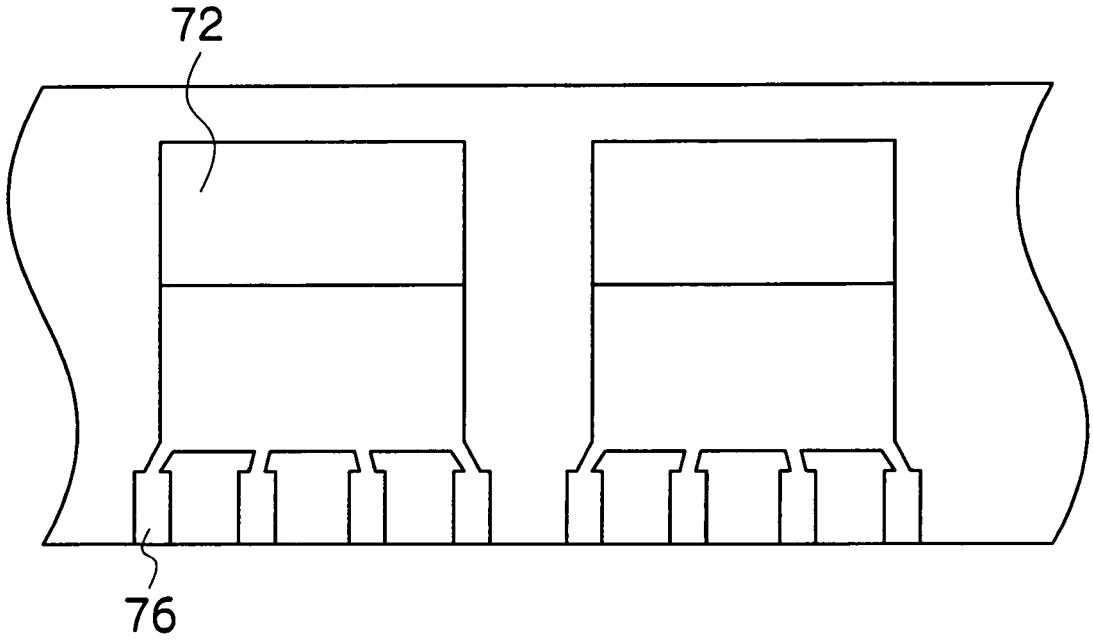
FIG. 12 is a plan view perspective diagram showing a further example of the composition of the head unit according to the second embodiment.

FIG. 11 is a plan view perspective diagram showing the principal part of a head unit 52' according to the second embodiment. As shown in FIG. 11, the pressure chambers 76 are arranged in the head unit 52' following the longer edge of the head unit 52', and the through channels 72 are arranged so as to be aligned on one side of the row of pressure chambers 76. Each of the through channels 72 is connected with two of the pressure chambers 76 in the same head unit 52'. The number of pressure chambers connected with each through channel 72 is not limited in particular. For example, it is also possible for four pressure chambers 76 to be connected with each through channel 72, as shown in FIG. 12.

Similarly to the first embodiment, it is possible in the second embodiment to achieve a high-density arrangement of the nozzles 60 by layering multiple head units 52' together, as well as being able to improve refilling characteristics.

The above-described embodiments relate to a mode using the full line head (long head) having a length corresponding to the maximum paper width, but the implementation of the present invention is not limited to this, and the present invention can also be applied to a serial head (short head) which records while scanning in the breadthways direction of the paper (sub-scanning direction).

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a head main body which is constructed from a plurality of head units layered together in a layering direction perpendicular to a liquid ejection direction of nozzles, each of the head units having the nozzles, pressure chambers connected with the nozzles and arranged in a one-dimensional configuration, and piezoelectric elements corresponding to the pressure chambers and arranged in a one-dimensional configuration, the head main body having through channels substantially parallel to the layering direction of the head units, the through channels being in connection with the pressure chambers; and first and second liquid accommodating chambers which are arranged on sides of the head main body opposing to each other in the layering direction of the head units, the first and second liquid accommodating chambers being in connection with the through channels.

2. The liquid ejection head as defined in claim 1, wherein the through channels are in connection with the pressure chambers through common channels, each of the head units having at least one of the common channels.

3. An image forming apparatus, comprising the liquid ejection head as defined in claim 1.

4. A liquid supply method for a liquid ejection head which comprises: a head main body which is constructed from a plurality of head units layered together in a layering direction perpendicular to a liquid ejection direction of nozzles, each of the head units having the nozzles, pressure chambers connected with the nozzles and arranged in a one-dimensional configuration, and piezoelectric elements corresponding to the pressure chambers and arranged in a one-dimensional configuration, the head main body having through channels substantially parallel to the layering direction of the head units, the through channels being in connection with the pressure chambers; and first and second liquid accommodating chambers which are arranged on sides of the head main body opposing to each other in the layering direction of the head units, the first and second liquid accommodating chambers being in connection with the through channels, the liquid supply method comprising the step of:

supplying liquid to the first and second liquid accommodating chambers in a state where the layering direction of the head units is substantially vertical.

* * * * *